US008047742B2

(12) United States Patent
Sick et al.

(10) Patent No.: US 8,047,742 B2
(45) Date of Patent: Nov. 1, 2011

(54) TAMPING DEVICE

(75) Inventors: Georg Sick, Feldafing (DE); Oliver Kolmar, Neubiberg (DE); Otto W. Stenzel, Neuhütten/Wüstenrot (DE); Andreas Bartl, Wörth (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 783 days.

(21) Appl. No.: 10/599,265

(22) PCT Filed: Mar. 24, 2005

(86) PCT No.: PCT/EP2005/003166

§ 371 (c)(1),
(2), (4) Date: Jul. 9, 2008

(87) PCT Pub. No.: WO2005/093160

PCT Pub. Date: Oct. 6, 2005

(65) Prior Publication Data

US 2010/0254769 A1 Oct. 7, 2010

(30) Foreign Application Priority Data

Mar. 25, 2004 (DE) ..... 10 2004 014 750

(51) Int. Cl.
*E01C 19/38* (2006.01)

(52) U.S. Cl. ..... 404/133.1; 404/133.05

(58) Field of Classification Search ..... 404/84.1, 404/133.05, 133.1
See application file for complete search history.

(56) References Cited

U.S. PATENT DOCUMENTS

| | | | | |
|---|---|---|---|---|
| 3,283,677 | A * | 11/1966 | Uebel | 404/113 |
| 3,923,412 | A * | 12/1975 | Linz | 404/133.05 |
| 4,127,351 | A * | 11/1978 | Vural | 404/72 |
| 6,394,697 | B1 * | 5/2002 | De Boer | 404/133.1 |
| 6,846,128 | B2 * | 1/2005 | Sick | 404/133.05 |
| 7,117,758 | B2 * | 10/2006 | Riedl | 74/87 |
| 7,144,195 | B1 * | 12/2006 | McCoskey | 404/133.1 |
| 7,354,221 | B2 * | 4/2008 | Congdon | 404/84.1 |

FOREIGN PATENT DOCUMENTS

| | | | |
|---|---|---|---|
| DE | 864 263 | C | 1/1953 |
| GB | 805 643 | A | 12/1958 |
| WO | 02/35005 | A | 5/2002 |

* cited by examiner

*Primary Examiner* — Gary S Hartmann
(74) *Attorney, Agent, or Firm* — Boyle Fredrickson, S.C.

(57) ABSTRACT

A vibrating plate serving as a tamping device comprises an upper mass equipped with a drive and comprises at least two lower masses, which are coupled to the upper mass while being able to oscillate relative to the upper mass. Each of the lower masses comprises a soil contacting plate and at least one oscillator assigned to this soil contacting plate. The oscillators can be controlled differently so that, in addition to an advancing and compacting action, a turning moment can be executed about a vertical axis (Z).

19 Claims, 5 Drawing Sheets

TAMPING DEVICE

BACKGROUND OF THE INVENTION

1. Field of the Invention

The present invention relates to a soil compacting device, in particular a vibration plate.

2. Description of the Related Art

Steerable and non-steerable vibration plates are known that can be controlled manually or remotely. Standardly, the vibration plates have an upper mass comprising, inter alia, a drive, e.g. a motor, as well as a lower mass that is coupled to the upper mass and that is capable of oscillatory movement relative to the upper mass. The lower mass is made up essentially of a soil contact plate to which a vibration exciter is fastened. The vibration exciter is driven by the drive of the upper mass, and has for example two imbalance shafts, situated parallel to one another, that are capable of rotation in directions opposite to one another with a positive fit. Each imbalance shaft bears one or more imbalance masses, so that during rotation with a positive fit a resultant force is produced. Depending on the phase position of the imbalance shafts or masses to one another, the direction of the resultant force can be set perpendicular to the axes of the imbalance shafts as desired by the operator. In this way, the vibration plates can be moved at least in the forward direction (main direction) and the backward direction.

In addition, vibration plates are known that are able to travel a curved path or to execute a rotation in place. For this purpose, on one of the imbalance shafts of the vibration exciter the imbalance mass is divided into two mass elements that can be moved separately from one another with respect to their phase position, or the imbalance shaft is divided into two sub-shafts. Given a different orientation of the resultant force that arises in the interaction with the oppositely situated, non-divided imbalance shaft, there arises a yaw moment about a vertical axis of the vibration plate, which causes a rotational movement.

The vibrations produced by the vibration exciter and the interaction with the soil cause the lower mass, in particular its soil contact plate, to execute a kind of wobbling movement on the soil. The wobbling movement effects the actual soil compacting.

In steerable vibration plates, i.e., vibration plates that are capable of rotation or of traveling in a curved path, the vibration exciter must handle three tasks simultaneously or in temporal succession. On the one hand, a propulsive force must be produced in order to move the vibration plate forwards and backwards with sufficient speed. In addition, a compacting effect is to be brought about in order to perform the actual aim of the device, namely soil compacting. Finally, a moment of rotation (yaw moment) is to be produced about the vertical axis of the vibration plate by differently controlling the imbalance masses to the right and to the left of a center plane of the vibration plate.

As a rule, performing these three tasks requires a compromise, so that none of these tasks can be optimally performed. In vibration plates in which only a change of direction is possible, the production of the propulsive force always entails a loss of compacting power. The compacting power is optimal only when the device is at a standstill, when the vibration exciter does not have to produce any propulsive forces. If the third function, i.e., the production of a rotational movement, also has to be performed by the vibration exciter, the compacting efficiency can be significantly reduced, which has a disadvantageous effect on the final result of the work, above all on the time required for compacting.

However, in the area of soil compacting, analogously to the general trend in the construction machine industry, the efficiency of compactors is becoming increasingly important so that compacting work can be performed in the shortest possible time.

Correspondingly, the required machines are becoming larger and heavier, and are therefore becoming more and more difficult to operate manually.

Other soil compacting devices are known in which a plurality of hydraulically operated compacting plates are fastened to a hydraulic bearer, e.g. a tractor-type vehicle standard on construction sites. The vibration plates are used exclusively for soil compacting, while the steering and guiding, as well as the propulsion, are taken over by the tractor vehicle. Such a system can be used in particular for compacting on inclined surfaces, while manually operated or remotely controlled vibration plates can be guided over inclined surfaces only with great difficulty. However, the vehicle-supported compacting devices have the disadvantage that the wheels often damage the surface of the compacted soil. In addition, the vehicles can be used economically only on large surfaces. Their maneuverability is very limited.

GB 805 643 A and DE 864 263 C each indicate soil compacting devices in which a plurality of vibration plates or stampers are combined by connecting elements to form a larger overall system. A separate drive is allocated to each vibration plate or to each stamper.

OBJECT OF THE INVENTION

The present invention is based on the object of indicating a soil compacting device in which arbitrary directions of locomotion, in particular arbitrary curved paths, are possible, while at the same time an improved compacting efficiency can nonetheless be achieved.

According to the present invention, this object is achieved by a soil compacting device as recited in claim 1. Advantageous further developments of the present invention are defined in the dependent claims.

A soil compacting device according to the present invention has at least one upper mass, comprising a drive, and at least two lower masses that are coupled to the upper mass and that are capable of oscillatory motion relative to the upper mass. Each of the lower masses comprises a soil contact plate and at least one vibration exciter allocated to the soil contact plate.

The fact that for one upper mass at least two (sub-)lower masses are provided that are coupled to the upper mass independently of one another means that each of the lower masses must simultaneously perform a maximum of only two functions. While in the prior art described above, vibration plates were capable of being steered only if the lower masses with their vibration exciters had to perform three functions (propulsion, yaw moment, compacting), resulting in the described disadvantages (in particular reduced compacting power), according to the present invention it is possible to adjust the lower masses to one another in such a way that each of the lower masses has to perform only two functions, e.g. propulsion and compacting. Different setting of the propulsive force can already for example produce a moment of rotation about the vertical axis of the upper mass, so that the soil compacting device as a whole can be steered. Correspondingly, for example one of the lower masses can produce its full compacting power while only the other lower mass generates a particular propulsive force.

Depending on the specific embodiment of the present invention, it is also possible for more than two lower masses to be coupled to a common upper mass. Here it is possible for the vibration exciters to be oriented differently, i.e., for the vibration exciters to be able to produce resultant force vectors whose horizontal components are oriented in different directions. The positioning of the vibration exciters can be used to create a situation in which a yaw moment can be produced about the vertical axis in order to achieve the desired steerability of the of the soil compacting device.

In a preferred specific embodiment of the present invention, at least one of the vibration exciters can be used to produce a resultant propulsive force in a direction of advance. In this way, the soil compacting device can easily and reliably be moved in the advance direction (main direction). The other vibration exciters can then be situated so that their propulsive force is oriented in a direction other than the main direction.

Suitable vibration exciters include in particular what are known as two-shaft exciters, already described above in connection with the prior art, in which two imbalance shafts that are capable of rotation in opposite directions are situated parallel to one another. In a modification, however, the imbalance shafts can also for example be situated at an angle to one another. Beginning from the known parallel situation of the imbalance shafts, this angle can correspond to an acute angle. However, the angle can also be selected to be larger, so that for example a right angle or an obtuse angle is conceivable. Finally, it is also possible to set an angle of 180° between the two shafts; such a vibration exciter then functions in the manner of a known plate compactor. A plate compactor having only one imbalance shaft (one-shaft exciter) can also be used as a vibration exciter.

If the imbalance shafts of the vibration exciters are not situated parallel to one another, the above definition of capability of rotation "in opposite directions" of the imbalance shafts is to be understood as meaning that if the imbalance shafts under consideration were pivoted out of their actual angular position into an imaginary parallel position, in this fictitious parallel position they would rotate in directions opposite to one another. The appropriate vibration exciters and the correct arrangement of the imbalance shafts can be selected by someone skilled in the art so as to suit the particular situation.

In a particularly advantageous specific embodiment of the present invention, at least one of the vibration exciters is situated in such a way that the horizontal component of the resultant force vector that results from the imbalance shafts rotating in opposite directions is not oriented in the main direction, or is oriented opposite to the main direction. The main direction is to be regarded as the travel direction of the soil compacting device that would be achieved under standard forward movement in a straight line. The vibration exciter not oriented in the main direction makes it possible to produce lateral forces that can very quickly effect a rotation of the soil compacting device about the vertical axis. If no rotation is desired, the phase position of the imbalance shafts of this vibration exciter should be set in such a way that the resultant force vector does not have a horizontal component, but only a vertical component. The vibration exciter then does not contribute to the steering of the soil compacting device, and produces exclusively vibrations used for soil compacting, so that a particularly good compacting efficiency can be achieved.

In another specific embodiment of the present invention, none of the vibration exciters is situated in such a way that the horizontal component of the resultant force vector is situated in a main direction or opposite to a main direction. Thus, all the vibration exciters are situated at a particular angle to the main direction. By corresponding adjustment of the force effect of the vibration exciters, it can nonetheless be ensured that the soil compacting device as a whole is capable of movement in the main direction.

This specific embodiment of the present invention can be used particularly advantageously for compacting inclined surfaces, in which the force of gravity amplifies a tendency to drift of the soil compacting device. Vibration exciters that are correspondingly set at an incline can be used to produce compensating forces that hold the soil compacting device on the inclined ground.

Advantageously, the upper mass has a central control device for controlling the vibration exciters. In a simple specific embodiment, the vibration exciters can all be controlled by the central control unit.

In a particularly advantageous specific embodiment of the present invention, it is however possible to control the vibration exciters individually using the control unit. A corresponding control logic system facilitates operation, so that for example the operator can simply input the desired direction of travel, e.g. using a joystick, and the control logic system will control the various vibration exciters in such a way that the soil compacting device travels in the desired direction, simultaneously achieving the greatest possible compacting effect.

In order to obtain the greatest flexibility in the control possibilities, the control unit is fashioned for the individual setting of different rotational speeds of the imbalance shafts in the various vibration exciters. This makes it possible to set a separate vibration frequency for each vibration exciter. In addition, in a preferred specific embodiment the control unit can individually control the phase adjustment devices provided on the individual vibration exciters for the individual adjustment of the relative phase position of the respective imbalance shaft.

In a particularly advantageous specific embodiment of the present invention, only some of the lower masses have a vibration exciter having a phase adjustment device, while at least one other lower mass has only a vibration exciter without a phase adjustment device. The latter vibration exciter then produces forces that can be used exclusively for soil compacting, but not for the propulsion or steering of the soil compacting device. In addition, due to the lack of the phase adjustment device this vibration exciter can have a particularly simple construction. In combination with at least one other vibration exciter having a phase adjustment device, a soil compacting device can be realized that achieves excellent compacting efficiency while also having good steerability.

In another advantageous specific embodiment of the present invention, the soil contact plates of the various imbalance masses are offset relative to one another in such a way that the tracks that can be produced by the soil contact plates during movement of the soil compacting device in at least one main direction of travel overlap one another at least partially. Thus, when the soil compacting device is traveling in the relevant main direction of travel, the soil contact plates produce partially overlapping tracks (contact areas) on the ground that is to be compacted. This ensures that the soil compacting device makes a unified (overall) track on the ground. Between the areas compacted by the individual soil contact plates, there do not remain any areas that are not traveled over by at least one soil contact plate. In this way, the soil compacting device according to the present invention achieves the same effect as a soil compacting device having only one lower mass on which a very large soil contact plate is provided.

These and additional advantages and features of the present invention are explained in more detail below on the basis of examples, with the aid of the accompanying Figures.

DETAILED DESCRIPTION OF THE PREFERRED EMBODIMENT

Figure 1:
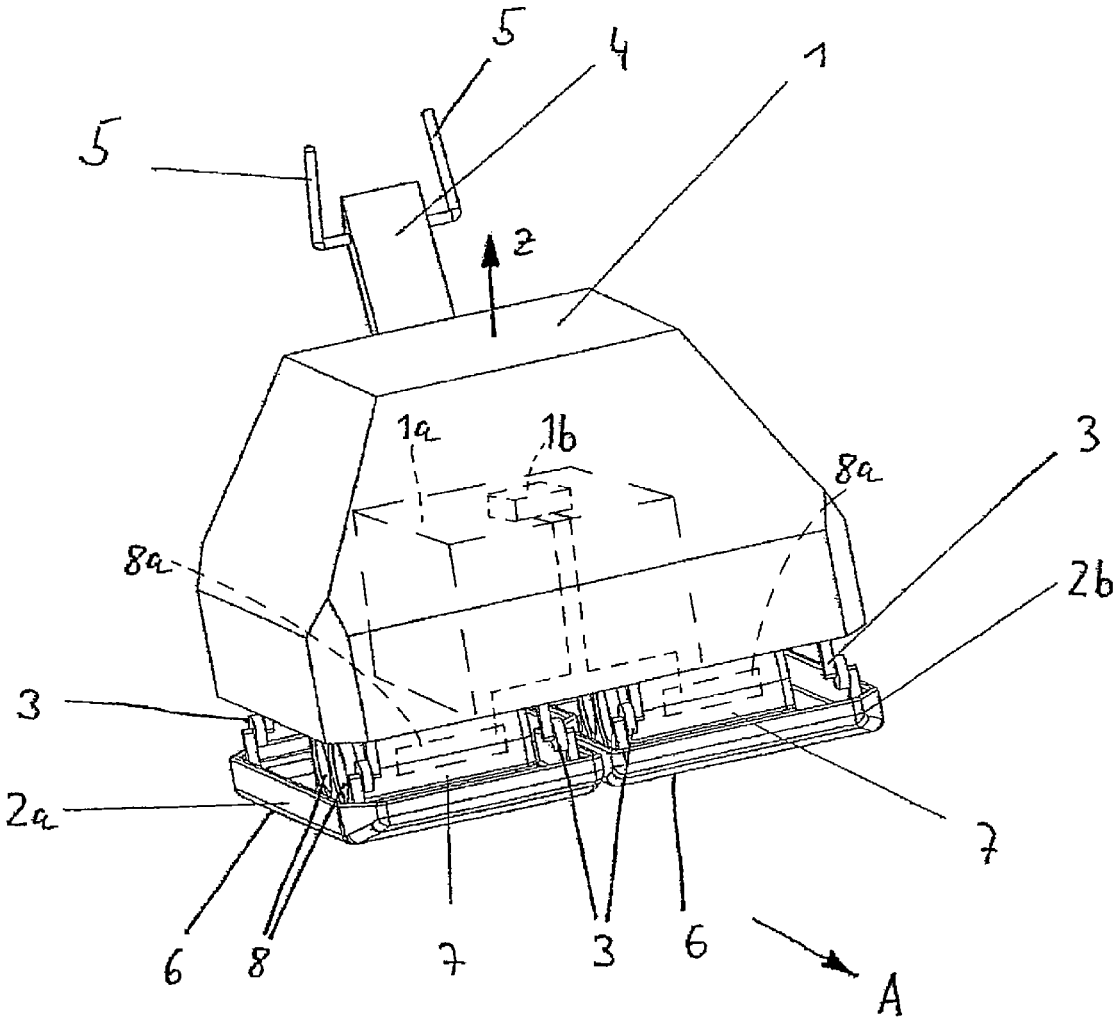
FIG. 1 shows a schematic perspective view of a first specific embodiment of the present invention.

FIG. 1 shows a vibration plate that acts as a soil compacting device according to the present invention and that has an upper mass 1 and two lower masses 2*a* and 2*b*. Lower masses 2*a* and 2*b* are each coupled to upper mass 1 and are capable of oscillatory movement relative thereto. For this purpose, between upper mass 1 and each of lower masses 2*a*, 2*b*, spring devices 3 are provided that are known, so that a further description of them is not necessary. Lower masses 2*a*, 2*b* form sub-lower masses of an overall lower mass that bears upper mass 1.

Lower masses 2*a*, 2*b* are situated alongside one another relative to a main direction A. Main direction A corresponds to the direction in which the vibration plate travels forward in normal operation.

In order to guide the vibration plate, a pole 4 is attached to upper mass 1. Pole 4 has operating levers 5 that are used to control the vibration plate. Instead of pole 4 and operating levers 5, it is also possible to control the vibration plate with the aid of a remote control system (not shown).

For each lower mass 2*a*, 2*b* that is to be controlled, at least one operating lever 5 should be provided in order to ensure individual controllability of lower masses 2*a* and 2*b*. If additional lower masses are provided, the number of operating levers 5 is to be increased correspondingly. Alternatively, operating lever 5 can also determine a target value for controlling, e.g. in the manner of a joystick, on the basis of which the individual lower masses are individually control. In this case, a reduced number of operating levers 5, or even only one operating lever 5, is sufficient to control the soil compacting device as a whole.

Each of lower masses 2*a*, 2*b* has a soil contact plate 6 and a vibration exciter 7 situated thereon. Each vibration exciter 7 is made up of two imbalance shafts 8 that are situated parallel to one another and that are coupled to one another with a positive fit so as to be capable of rotation in opposite directions, and that are rotationally driven, e.g. hydraulically, by a drive not shown 1*a* that is situated on upper mass 1. The design of vibration exciters 7 has long been known, so that a detailed description is not required.

Each imbalance shaft 8 bears an imbalance mass (not shown), so that a corresponding centrifugal force arises during the rotation of imbalance shafts 8. Due to the fact that the two imbalance shafts 8 allocated to a respective vibration exciter 7 rotate in opposite directions, a resultant force arises whose direction can be set through the phase position of the imbalance masses or imbalance shafts 8. For this purpose, a phase adjustment device 8*a* is provided with which the phase of the two imbalance shafts 8 relative to one another can be adjusted in the desired manner.

With the aid of operating lever 5 and a hydraulic or electrical control unit 1*b*, the phase adjustment devices 8*a* of the two vibration exciters 7 of imbalance masses 2*a*, 2*b* can be set individually. This makes it possible to vary the resultant forces produced by vibration exciters 7. If, for example, the resultant forces both have an equally large horizontal component in main direction A, the vibration plate will move uniformly forward in direction A. The vibration plate can also travel backwards, opposite main direction A, if the horizontal components of the two vibration exciters 7 point in the opposite direction with the same magnitude. If, however, the phase position of imbalance shafts 8 is set differently for the two vibration exciters 7, differently oriented resultant forces arise that correspondingly have different horizontal components. In this way, a moment of rotation or yaw moment arises about a vertical axis Z of the vibration plate, so that a steering of the vibration plate is effected.

Due to the fact that the two vibration exciters 7 of sub-lower masses 2*a* and 2*b* need each have in themselves no steering function, but rather must merely achieve a propulsion effect and a compacting effect, both propulsion and compacting can be carried out with a high degree of energy efficiency. The weakening of the compacting efficiency which otherwise occurs in steerable vibration plates is therefore avoided.

Travel along a curve to the left can for example be achieved in that, for example, vibration exciter 7 of right lower mass 2*a* produces a resultant force that is strongly directed forward, while vibration exciter 7 of left lower mass 2*b* produces a resultant force that is not so strongly directed forward, or is even directed rearward. Correspondingly, a rotation in place can even be achieved.

Figure 2:
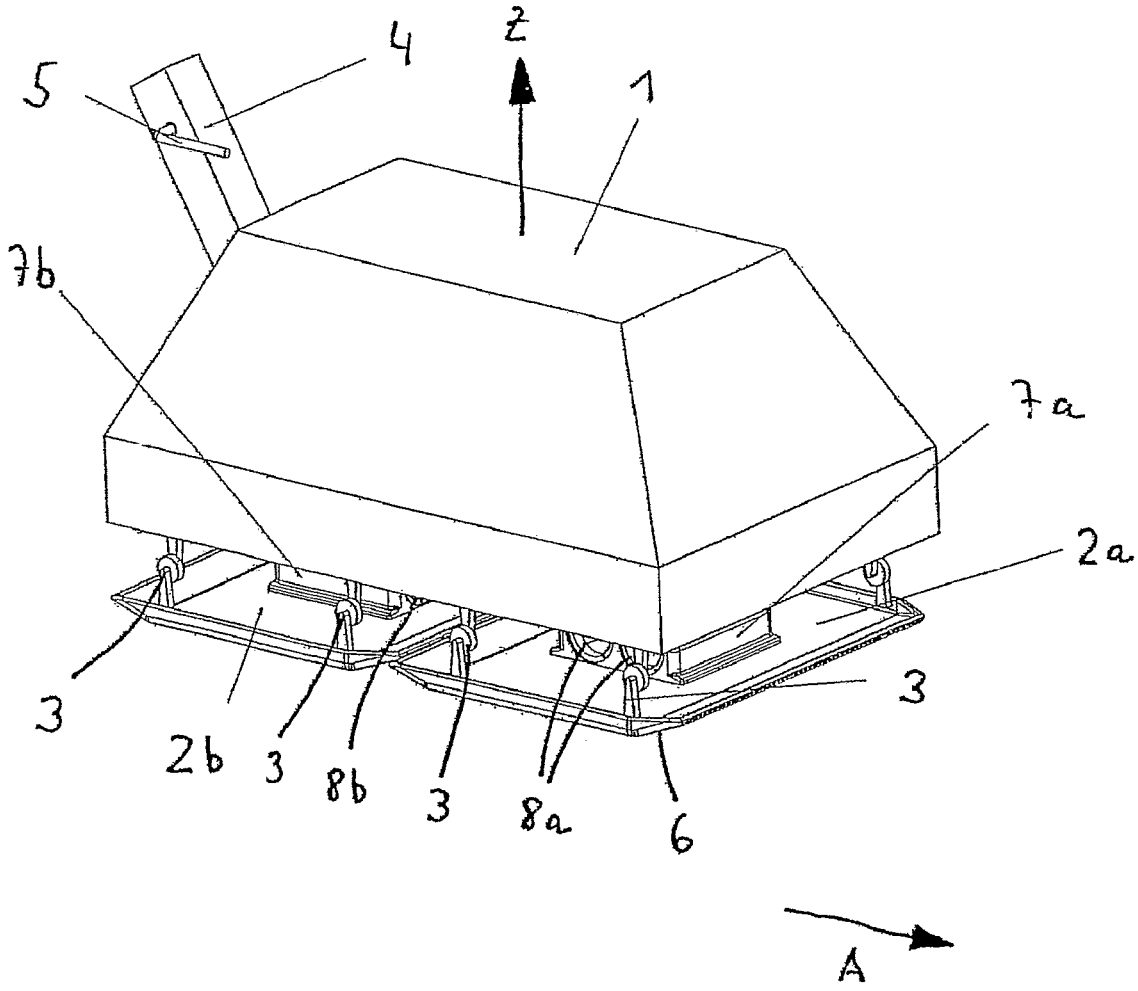
FIG. 2 shows a perspective view of a second specific embodiment of the present invention.

FIG. 2 shows a vibration plate as a second specific embodiment of the present invention. Because the individual components correspond essentially to the first specific embodiment, the same reference characters are used, and reference is made to the functions described in connection with FIG. 1.

In contrast to the first specific embodiment of FIG. 1, in the second specific embodiment the lower masses 2*a* and 2*b* are situated one after the other.

Vibration exciter 7*a*, situated on soil contact plate 6 of front lower mass 2*a*, has two imbalance shafts 8*a* whose axis is situated perpendicular to main direction A. Correspondingly, the resultant force produced by vibration exciter 7*a* can be set in direction A or opposite direction A.

In contrast, rear lower mass 2*b* bears a vibration exciter 7*b* whose imbalance shafts 8*b* have axes of rotation that are oriented in main direction A. Correspondingly, vibration exciter 7*b* produces a resultant force that is oriented perpendicular, i.e. transverse, to main direction A.

During operation of the vibration plate, front vibration exciter 7*a* produces a propulsion effect in main direction A. If the vibration plate is to be driven only straight ahead, rear vibration exciter 7*b* is set so that it produces a vertical oscillation without no horizontal force component. If however the vibration plate is to be steered, the phase position of imbalance shafts 8*b* in vibration exciter 7*b* is correspondingly adjusted so that a resultant force arises that has a correspondingly oriented horizontal component. In this way, a moment of rotation is effected about vertical axis Z, and the vibration plate is correspondingly steered.

On the basis of the two described examples, the system according to the present invention can be expanded arbitrarily. Thus, it is for example conceivable for sub-lower masses to be designed that assume exclusively a compacting function. Here, vibration exciters would be used that do not have a phase adjustment device, and that therefore produce exclusively resultant forces in the vertical direction, without a horizontal component. The propulsive function would then be taken over by one or more other sub-lower masses.

Likewise, it is conceivable that a second direction of motion, perpendicular to the first direction of motion (e.g. main direction A), be effected by correspondingly situated sub-lower masses. In this way, in addition to or in place of an arbitrary curved path, a transverse or oblique path relative to main direction A is also possible. An oblique path is advantageous in particular in the compacting of laterally inclined surfaces, because the drifting away of the vibration plate, caused by gravity, can be counteracted. In connection with a remote control device, the vibration plate can be driven without large corrective interventions, and without rotating the upper mass obliquely along the inclined surface.

In the second specific embodiment shown in FIG. 2, the two vibration exciters 7*a* and 7*b* are situated at a 90° angle to one another. Arrangements are also conceivable in which the angle between the vibration exciters deviates from 90°. For example, the resultant forces produced by the vibration exciters can be set at an angle of 30° or 60° to main direction A; i.e., in a V shape. In the first specific embodiment according to FIG. 1, the angle is 0°.

Figure 3:
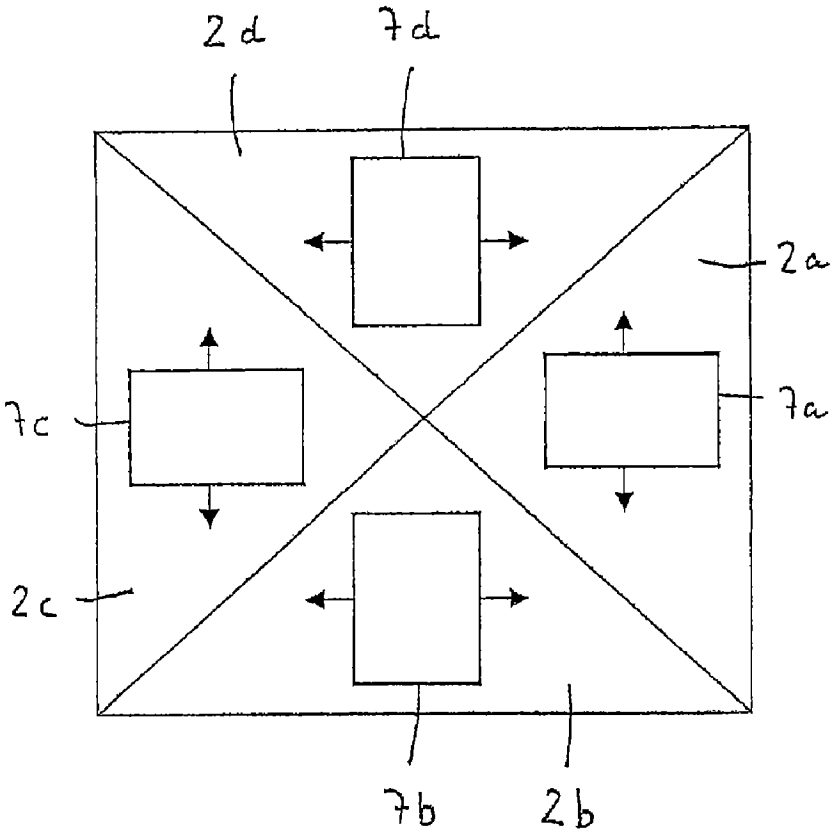
FIG. 3 shows a schematic top view of lower masses in a third specific embodiment of the present invention.

FIG. 3 shows a third specific embodiment of the present invention having four sub-lower masses 2*a*, 2*b*, 2*c*, and 2*d*, each bearing a triangular soil contact plate and a vibration exciter 7*a*, 7*b*, 7*c*, 7*d*. Vibration exciters 7*a* and 7*c* are identically oriented, while vibration exciters 7*b* and 7*d* are oriented at an angle of 90° thereto. Because the overall lower mass, made up of sub-lower masses 2*a* to 2*d*, has a square outline, upper mass 1 can correspondingly also be formed essentially with a square basic shape. The resulting vibration plate can move equally comfortably in any direction in the plane, depending on the controlling of vibration exciters 7*a* to 7*d*.

Figure 4:
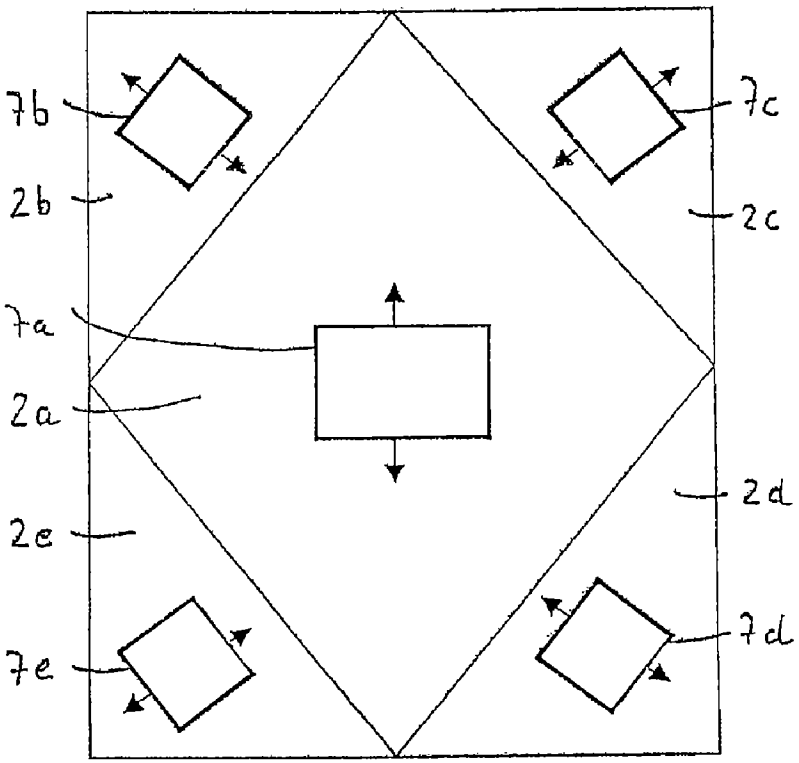
FIG. 4 shows a schematic top view of lower masses in a fourth specific embodiment of the present invention.

FIG. 4 shows a fourth specific embodiment of the present invention, in which four smaller sub-lower masses 2*b* to 2*e* are situated around a larger sub-lower mass 2*a*. Vibration exciter 7*a*, associated with sub-lower mass 2*a*, is likewise designed to be stronger than smaller vibration exciters 7*b* to 7*e*. Small vibration exciters 7*b* to 7*e* carry out for example only slight steering corrections, while a considerable part of the compacting effect is achieved by larger vibration exciter 7*a*.

Figure 5:
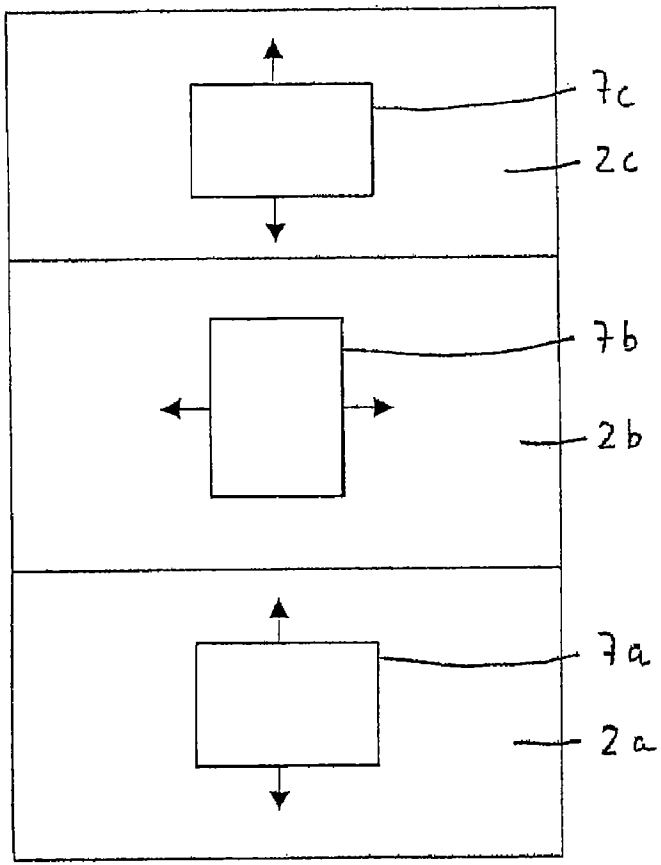
FIG. 5 shows a schematic top view of lower masses in a fifth specific embodiment of the present invention.

FIG. 5 shows a fifth specific embodiment of the present invention having three sub-lower masses 2*a*, 2*b*, and 2*c*. Vibration exciters 7*a* and 7*c* have the same orientation, while center vibration exciter 7*c* is oriented at an angle of 90° thereto.

Figure 6:
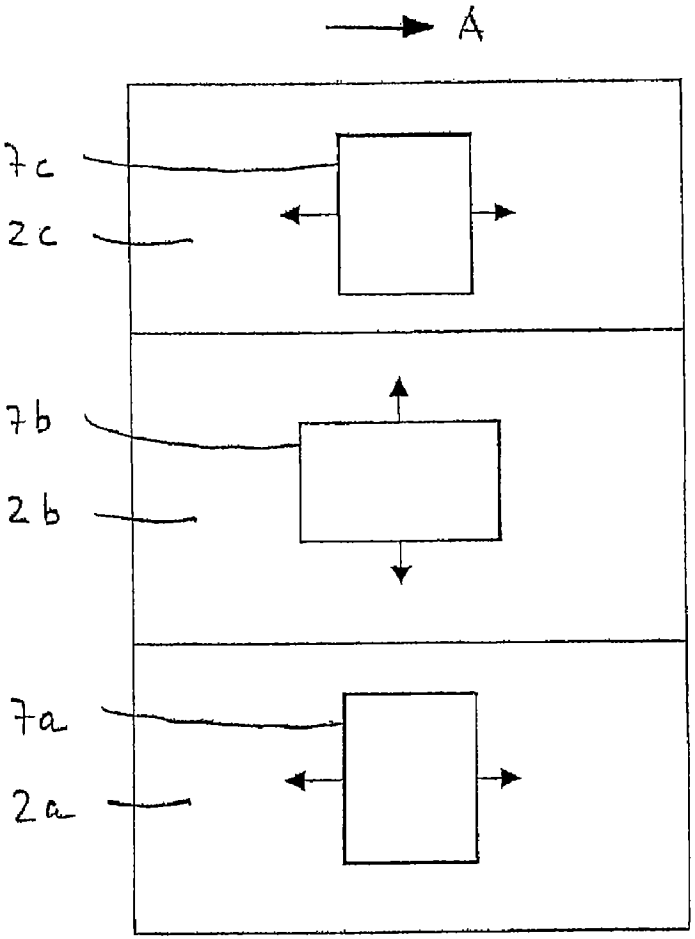
FIG. 6 shows a schematic top view of lower masses in a sixth specific embodiment of the present invention.

In the sixth specific embodiment of the present invention according to FIG. 6, vibration exciters 7*a* to 7*c* are each rotated by 90° relative to the fifth specific embodiment, and vibration exciters 7*a* and 7*c* act in main direction A. Correspondingly, vibration exciter 7*b*, situated in the center, is not required to produce a resultant force having a horizontal component. In this variant, vibration exciter 7*c* can thus be used exclusively for compacting. A phase adjustment device is then not required in this vibration exciter 7*b*.

Figure 7:
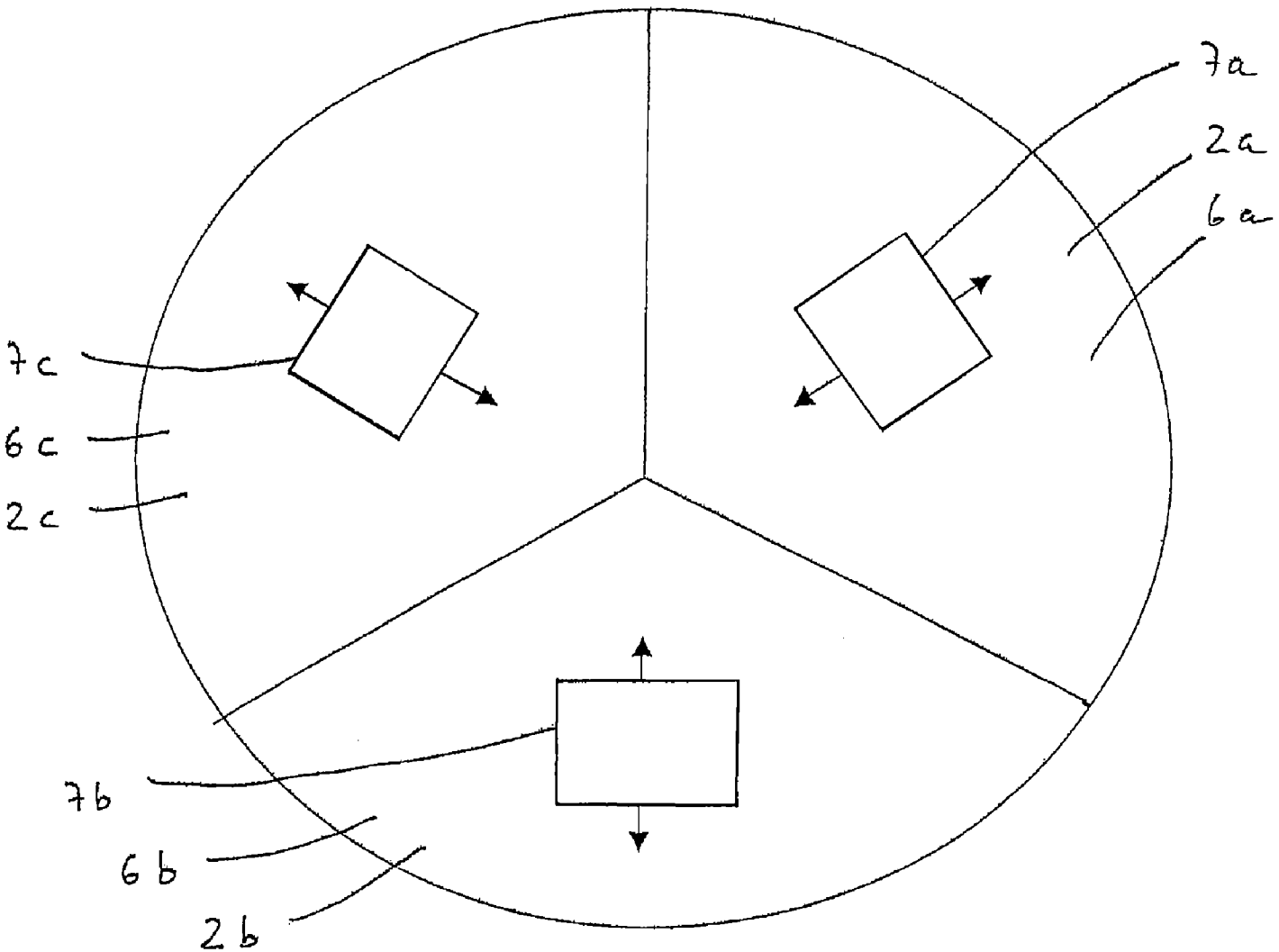
FIG. 7 shows a schematic top view of lower masses in a seventh specific embodiment of the present invention.

FIG. 7 shows a seventh specific embodiment of the present invention, in which the three sub-lower masses 2*a* to 2*c* each have soil contact plates 6*a* to 6*c* that form a 120° sector of a circle. The lower mass as a whole is therefore circular. Vibration exciters 7*a* to 7*c* are situated at an angle of 120° to one another, so that arbitrary directions of propulsion can be produced. The correspondingly shaped vibration plate can travel in any direction on the soil that is to be compacted.

In situating the soil contact plates, care is to be taken that the soil contact plates "engage with one another," so that an overlapping is ensured at least in the main directions of travel. The overlapping has the effect that the contact surfaces over which the soil contact plates travel likewise overlap partially with the soil that is to be compacted, so that no surface areas that are not compacted remain between the soil contact plates. The soil compacting device thus acts in the manner of a unit that operates with a single large soil contact plate.

The controlling takes place via operating lever 5, or also other operating elements with which the vibration exciter can be controlled in the desired manner. The signal transmission can take place e.g. via a hydrostatic hydraulic controlling, mechanically, electrically, or via combinations thereof. Imbalance shafts 8 of vibration exciter 7 can be driven e.g. hydraulically, electrically, or mechanically.

The invention claimed is:

1. Soil compacting device, comprising:

a common upper mass having a drive; and at least two lower masses that are coupled to the upper mass and that are capable of oscillatory movement relative to the upper mass, each lower mass having a soil contact plate and at least one vibration exciter that is allocated to the soil contact plate and that is driven by the drive, and wherein a resultant propulsive force in a direction of propulsion can be produced at least by one of the vibration exciters of the at least two lower masses.

2. A soil compacting device as recited in claim 1, wherein the vibration exciters have two or more imbalance shafts, each bearing one or more imbalance masses that are situated parallel to one another or at an angle to one another and that are capable of rotation in opposite directions to one another.

3. A soil compacting device as recited in claim 2, wherein the vibration exciters have a phase adjustment device for adjusting the relative phase position of the imbalance shafts to one another.

4. Soil compacting device as recited in claim 1, wherein exactly one vibration exciter is situated on each soil contact plate.

5. A soil compacting device as recited in claim 2, wherein the vibration exciters are situated in such a way that the horizontal component of the resultant force vector resulting from the imbalance shafts rotating in opposite directions to one another is oriented in or opposite to a main direction (A).

6. A soil compacting device as recited in claim 2, wherein the vibration exciters are situated in such a way that the horizontal component of the resultant force vector that results from the imbalance shafts rotating in opposite directions is not oriented in or opposite to a main direction (A).

7. A soil compacting device as recited in claim 2, wherein no none of the vibration exciters are situated in such a way that the horizontal component of the resultant force vector that results from the imbalance shafts rotating in opposite directions is oriented in or opposite to a main direction (A).

8. A soil compacting device as recited in claim 2, wherein the vibration exciters are situated in such a way that the horizontal component of the resulting force vector that results from the imbalance shafts rotating in opposite directions is oriented at a particular angle to a main direction (A).

9. A soil compacting device as recited in claim 8, wherein the angle is 60° or 90°.

10. A soil compacting device as recited in claim 8, wherein the upper mass has a central control unit for controlling the vibration exciters.

11. A soil compacting device as recited in claim 10, wherein the vibration exciters are capable of being controlled individually by the control unit.

12. A soil compacting device as recited in claim 10, wherein the control unit is fashioned for the setting of different rotational speeds of imbalance shafts in different vibration exciters.

13. A soil compacting device as recited in claim 10, wherein the control unit is fashioned for the individual controlling of the phase adjustment devices provided on the individual vibration exciters.

14. A soil compacting device as recited in claim 1, wherein at least one of the lower masses each has a vibration exciter having a phase adjustment device, while at least one other lower mass has only a vibration exciter that does not have a phase adjustment device.

15. A soil compacting device as recited in claim 1, wherein the soil compacting device can be guided by hand and/or has a remote control device.

16. A soil compacting device as recited in claim 1, wherein the soil contact plates of the imbalance masses are situated so as to be offset to one another in such a way that the tracks that can be produced on the soil that is to be compacted during movement of the soil compacting device in at least one main direction of travel overlap at least partially.

17. Soil compacting device, comprising:

an upper mass having a drive; and at least two lower masses that are coupled to the upper mass and that are capable of oscillatory movement relative to the upper mass, each lower mass having a soil contact plate, and at least two vibration exciters that act on the soil contact plate and that are driven by the drive, at least one of the vibration exciters being adjustable so that the soil compacting device as a whole generates a resultant propulsive force having a component acting in a horizontal main direction (A) to moves the soil compacting device in the main horizontal direction.

18. A soil compacting device as recited in claim 17, wherein the at least one vibration exciter is adjustable so that the resultant propulsive force has a lateral force component that rotates the soil compacting device about a vertical axis.

19. A soil compacting device as recited in claim 17, further comprising a control unit that is located on the upper mass that that controls each of the vibration exciters individually.

* * * * *